US006316871B2

(12) United States Patent
Park

(10) Patent No.: US 6,316,871 B2
(45) Date of Patent: Nov. 13, 2001

(54) COMPENSATION DEVICE FOR CONVERGENCE DRIFT USED IN CATHODE RAY TUBE

(75) Inventor: Young-Gi Park, Suwon (KR)

(73) Assignee: Samsung SDI Co., LTD, Kyungki-do (KR)

( * ) Notice: Subject to any disclaimer, the term of this patent is extended or adjusted under 35 U.S.C. 154(b) by 0 days.

(21) Appl. No.: 09/759,816

(22) Filed: Jan. 11, 2001

(30) Foreign Application Priority Data

Jan. 12, 2000 (KR) ..... 2000-1393

(51) Int. Cl.[7] ..... H01J 29/50

(52) U.S. Cl. ..... 313/412; 313/414; 313/479; 313/477 R; 313/425; 313/437; 313/477 HC; 315/382

(58) Field of Search ..... 313/412, 414, 313/479, 421, 428, 437, 477 R, 438, 439, 477 HC; 315/382

(56) References Cited

U.S. PATENT DOCUMENTS 4,503,357 3/1985 Ouhata et al. ..... 315/1
4,564,786 1/1986 Baum et al. ..... 313/479
4,868,454 9/1989 Paridaens ..... 313/412
5,015,925 * 5/1991 Spanjer et al. ..... 315/382

FOREIGN PATENT DOCUMENTS

9201839 * 3/1992 (KR) ..... H01J/29/88

* cited by examiner

*Primary Examiner*—Nimeshkumar D. Patel
*Assistant Examiner*—Sikha Roy
(74) *Attorney, Agent, or Firm*—Christie, Parker & Hale, LLP

(57) ABSTRACT

A compensation device for convergence drift used in a CRT, including a convergence electrode attached on an outer surface of a neck portion, an inducement means for inducing static electricity from a voltage to be supplied for an inner graphite layer, and a connecting member formed between the convergence electrode and the inducement means to supply high potential from the inducement means to the convergence electrode. As the convergence electrode provides high potential generated from the inducement means to the neck portion, the compensation device decreases the potential difference between grid electrodes and the neck portion. Thus, the compensation device makes the electric fields, which cause the charges to be accumulated, to weaken so that the convergence drift is effectively reduced.

14 Claims, 8 Drawing Sheets

COMPENSATION DEVICE FOR CONVERGENCE DRIFT USED IN CATHODE RAY TUBE

CROSS-REFERENCE TO RELATED APPLICATION

This application claims priority of Korea patent Application No. 2000-1393, filed on Jan. 12, 2000.

BACKGROUND OF THE INVENTION (a) Field of the Invention

The present invention relates to a compensation device for convergence drift used in a cathode ray tube, and more particularly, to a device capable of reducing an occurrence of convergence drift due to electric charges accumulated on an inner surface of a neck portion thereof.

(b) Description of the Related Art

A cathode ray tube (CRT) is a device for displaying images on a screen by emitting electron beams from an electron gun assembly and landing the electron beams onto a phosphor screen. The electron gun assembly is mounted in a neck portion, and includes three cathodes for emitting electrons and a plurality of grid electrodes for generating electric lenses therebetween to control the focusing and accelerating degree of the electron beams.

After three electron beams are emitted, they are horizontally and vertically deflected by magnetic fields generated by a deflection yoke, and divided onto corresponding red, green and blue phosphor layers respectively through a shadow mask. Thus, the electron beams strike all pixels on the phosphor screen.

In such a CRT, a voltage supplied to a vacuum bulb when the CRT starts operation leaks to the neck portion with time because of a high potential difference between the grid electrodes and the neck portion. Consequently, electric charges in the bulb are continuously accumulated on an inner surface of the neck portion.

Because the accumulated charges generate new electric fields, they change the path of electron beams passing on the grid electrodes and vary the convergence degree of the beams. Thus, the charges cause "convergence drift" that allows deterioration of image quality.

To reduce the convergence drift, U.S. Pat. No. 4,868,454, 4,564,786 and 4,503,357 provide the use of conductive tape attached on an outer surface of the neck portion for early stabilization of the convergence drift.

However, the conductive tape that is simply attached on the neck portion is under a floating condition that makes a uniform potential state unattainable. Thus, the conductive tape is sensitive to outer influences, for example approach of charged materials and variation of humidity, so that it is difficult to operate in a stable fashion.

In particular, when the conductive tape is placed opposite to intervals between the grid electrodes, minute potential variation of the conductive tape has a great deal of influence on the electric lenses generated in the intervals. Such variation of the electric lenses impedes accurate control of the electron beams.

Also, when the conductive tape is grounded, it easily increases potential differences and intensity of electric fields between the grid electrodes and the neck portion. Thus, the grounded conductive tape has a tendency to increase the convergence drift as the electric fields increase the accumulated charges on the neck portion.

SUMMARY OF THE INVENTION

It is an object of the present invention to provide a compensation device capable of reducing the convergence drift by weakening electric fields formed between the grid electrodes and the neck portion, the electric fields causing the charges to be accumulated on the neck portion.

In order to achieve this object, the compensation device includes a convergence electrode provided on an outer surface of the neck portion, an inducement means for inducing high potential from voltage to be supplied to an inner graphite layer, and a connecting member formed between the convergence electrode and the inducement means to supply the potential from the inducement means to the convergence electrode.

The inducement means can be provided on an outer surface of a cone portion to induce high potential from voltage supplied to the inner graphite layer. Alternatively, the inducement can be provided on a voltage supply line, for transmitting voltage to the inner graphite layer to induce high potential from voltage passing on the line.

As the inducement means provides high potential to the neck portion through the convergence electrodes, it can decrease the potential difference between the grid electrodes and the neck portion. Thus, the compensation device makes the electric fields, which cause the charges to be accumulated, to weaken so that it can effectively reduce the convergence drift.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings wherein.

DETAILED DESCRIPTION OF THE PREFERRED EMBODIMENTS

A preferred embodiment of this invention will be explained with reference to the accompanying drawings.

Figure 1:
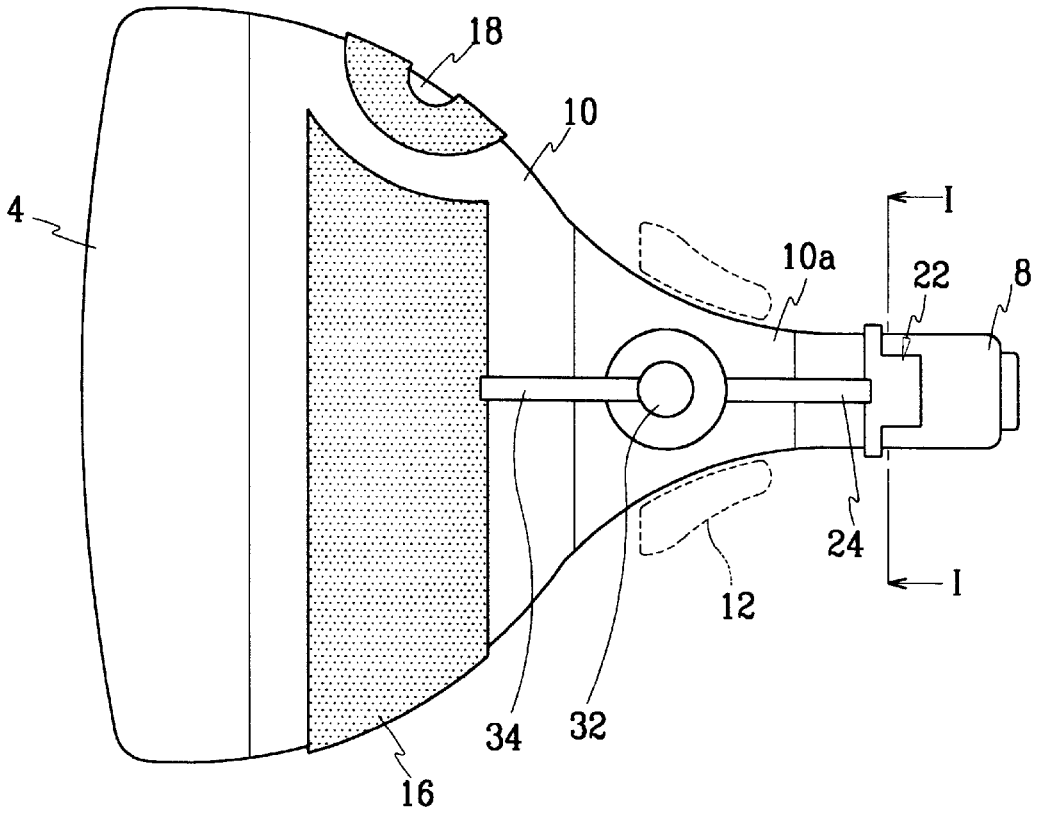
FIG. 1 is a lateral view of a CRT having a compensation device according to a first embodiment of the present invention.
Figure 2:
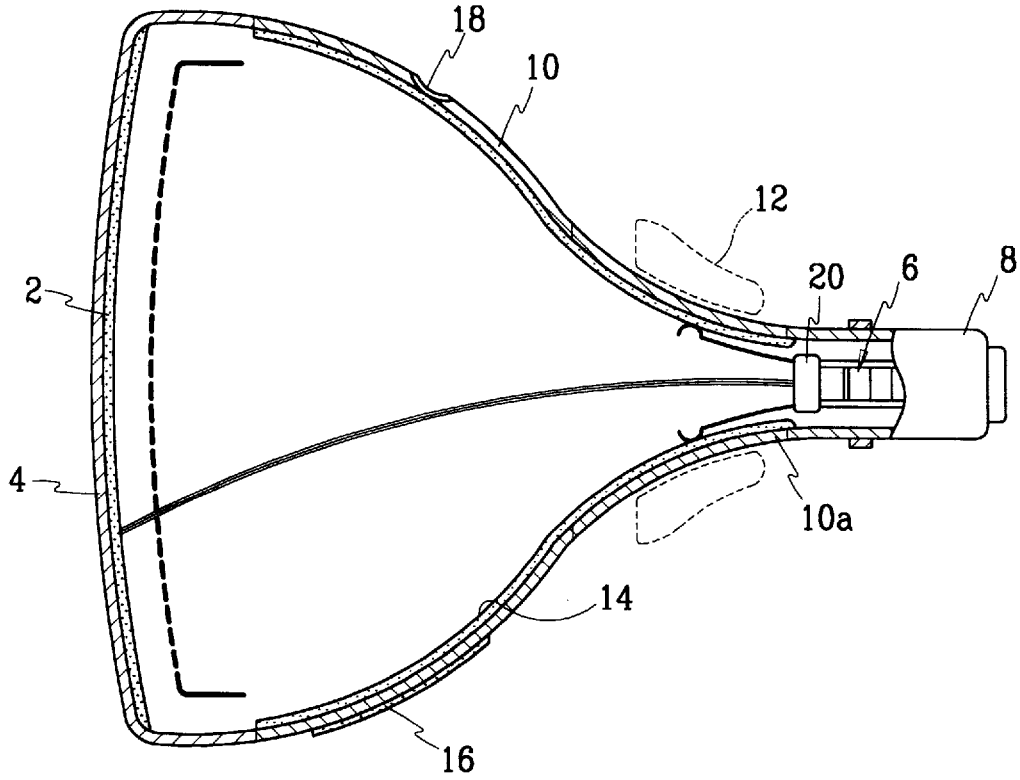
FIG. 2 is a sectional view of the CRT shown in FIG. 1.

As shown in FIGS. 1 and 2, a CRT according to a preferred embodiment of the present invention includes a vacuum bulb which is formed with a face panel 4 having a phosphor screen 2, a neck portion 8 in which an electron gun assembly 6 is arranged, and a funnel 10 placed between the face panel 4 and the neck portion 8.

The funnel 10 includes a cone portion 10*a*, formed adjacent to the neck portion 8, on which a deflection yoke 12 is mounted. An inner graphite layer 14 is coated on a whole inside surface of the funnel 10 and a partial inside surface of the neck portion 8, while an outer graphite layer 16 is coated on a partial outside surface of the funnel 10.

The inner graphite layer 14 is supplied with high voltage, for example about 25 kV, through an anode button 18 formed on the funnel 10, and transmits the voltage to a shield cup 20 and the last grid electrode of the electron gun assembly 6.

The inner and outer graphite layers, each coated on the inner and outer surface of the funnel 10, constitute a condenser having the funnel glass as a dielectric substance. Thus, the outer graphite layer 16 can stabilize high voltage of the inner graphite layer 14.

In the above CRT, a compensation device for convergence drift according to a first embodiment of the present invention is provided on an outer surface of the vacuum bulb.

The compensation device includes a convergence electrode 22 formed on an outer surface of the neck portion 8, an inducement means placed on the cone portion 10*a* and inducing static electricity from the voltage supplied to the inner graphite layer 14, and a connecting member 24 formed between the convergence electrode 22 and the inducement means to supply high potential from the inducement means to the convergence electrode 22.

The convergence electrode 22 is made of a metal layer having high conductivity, for example a copper sheet, and surrounds the circumference of the neck portion 8 with a predetermined width. Thus, the convergence electrode 22 provides high potential from the inducement means to the outer surface of the neck portion 8.

Figure 3A:
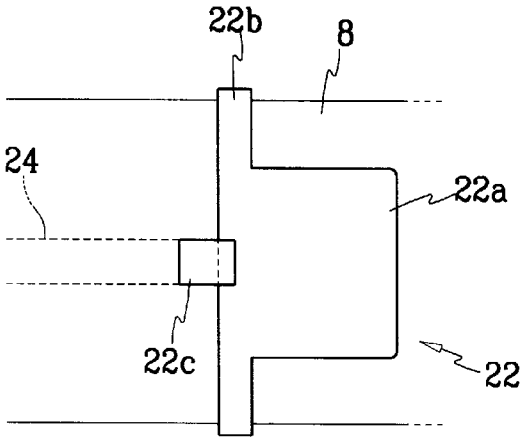
FIG. 3*a* is a lateral view of a neck portion shown in FIG. 1.
Figure 3B:
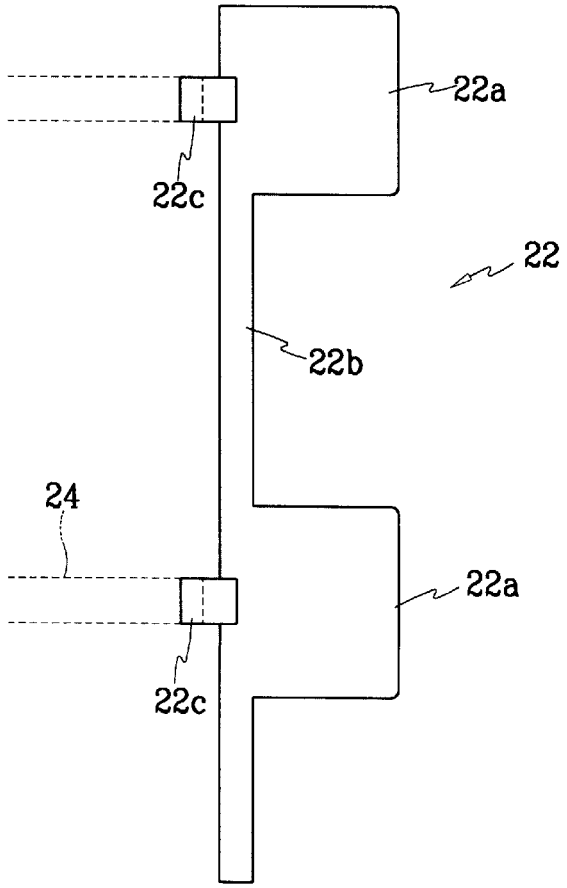
FIG. 3*b* is a development view of a convergence electrode shown in FIG. 3*a;*
Figure 3C:
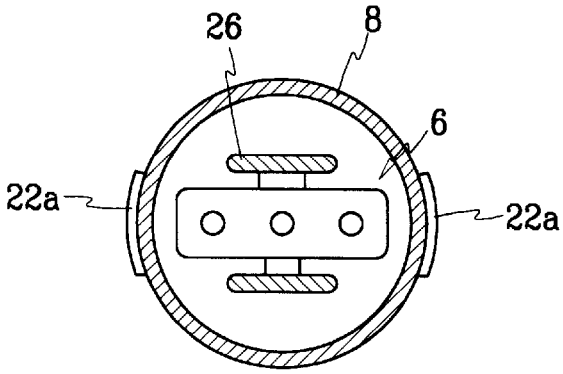
FIG. 3*c* is a sectional view taken along line I—I of FIG. 1.

As shown in FIGS. 3*a*~3*c*, the convergence electrode 22 is formed with a pair of potential supply portions 22*a* located opposite each other centering around the neck portion 8, a joining portion 22*b* connecting the two potential supply portions 22*a* in a body, and a terminal portion 22*c* attached with the connecting member 24.

The potential supply portions 22*a* are desirably attached on the right and left sides of the neck portion 8 respectively so as not to be aligned with a pair of bead glasses 26 for supporting grid electrodes in the electron gun assembly 6.

The terminal portion 22*c*, when the inducement means comprises pairs, provides another terminal portion 22*c* to each connection with the connecting members 24 which extend from the inducement means.

To supply high potential to the convergence electrode 22, the inducement means is provided on the outer surface of the cone portion 10*a* so that it induces static electricity from the voltage supplied to the inner graphite layer 14.

Figure 4A:
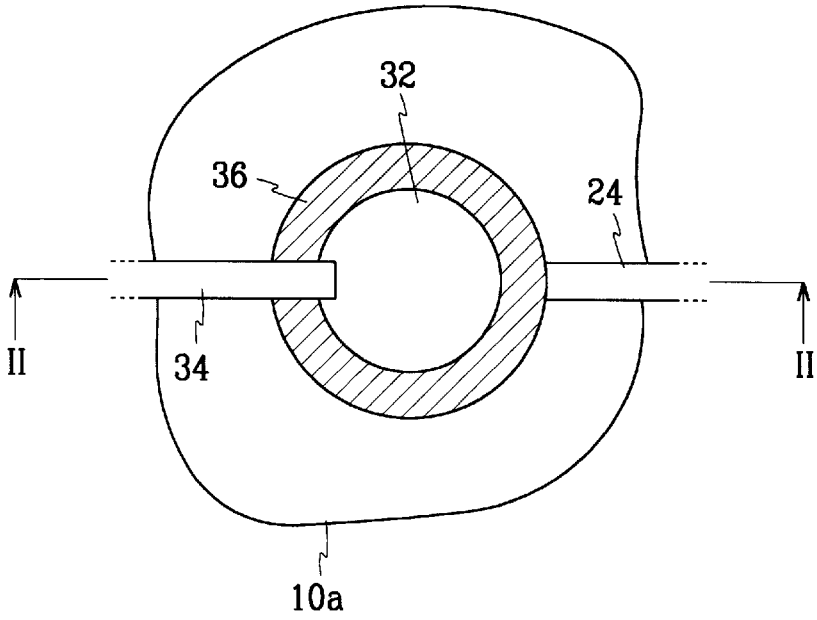
FIG. 4*a* is a lateral view of an inducement means shown in FIG. 1.
Figure 4B:
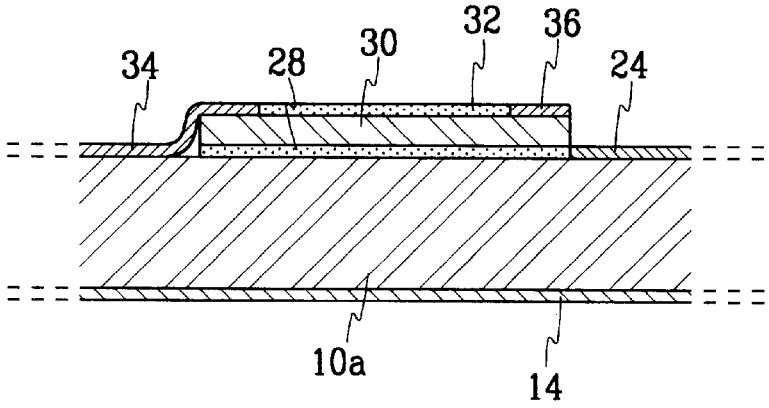
FIG. 4*b* is a sectional view taken along line II—II of FIG. 4*a;*

As shown in FIGS. 4*a* and 4*b*, the inducement means is formed with an inducing electrode 28, a dielectric layer 30, and a ground electrode 32 which are layered successively from the surface of the cone portion 10*a* to the upper direction.

The inducing electrode 28 connects electrically with the convergence electrode 22 through the connecting member 24. For example, the ground electrode 32 is grounded from the outer graphite layer 16 through another connecting member 34 as shown in FIG. 1.

Accordingly, the inner graphite layer 14 is formed on the inner surface of the cone portion 10*a*, while the inducing electrode 28, the dielectric layer 30, and the ground electrode 32 are successively layered on the outer surface of the cone portion 10*a*.

Figure 5:
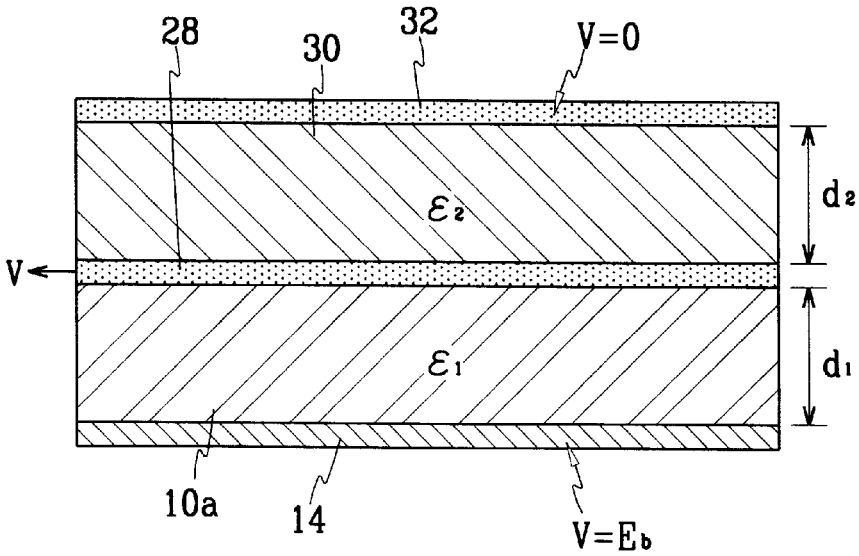
FIG. 5 is a schematic view illustrating inducement principles of static electricity.

In the above structure, the inner graphite layer 14 is supplied with voltage of Eb from the anode button 18, while the ground electrode 32 maintains zero voltage as shown in FIG. 5. When the cone portion 10*a* made of glass and the dielectric layer 30 have dielectric constants of $\epsilon 1$ and $\epsilon 2$ and thicknesses of d1 and d2 respectively, the voltage V induced to the inducing electrode 28 can be expressed by mathematical formula 1.

$$V = \frac{1}{1 + \frac{\varepsilon_2 d_1}{\varepsilon_1 d_2}} sEb \tag{1}$$

Therefore, when the voltage Eb is supplied to the inner graphite layer 14, the inducement means can induce static electricity of voltage V to the inducing electrode 28 according to the mathematical formula 1.

To enhance inducing voltage V, the dielectric layer 30 desirably has a smaller dielectric constant and is formed relatively thickly. For example, the dielectric layer 30 can be composed of polyester film having a dielectric constant of about $17.71\times10^{-12}$ ~$26.56\times10^{-12}$ F/m.

And the ground electrode 32 is preferably formed smaller than the inducing electrode 28. That is, a ground electrode which is formed bigger than the inducing electrode 28 makes the potential difference between the two electrodes decrease so as to cause the inducing voltage V to be reduced.

Moreover, when the ground electrode 32 is formed extending to an edge of the dielectric layer 30, discharges are easily generated between the two electrodes.

In addition, to ensure high resistance between the ground electrode 32 and the inducing electrode 28, an insulating layer 36, for example a layer of red silicon, is formed around the ground electrode 32.

The compensation device can provide another inducement means to induce static electricity more effectively. Each of the inducement means is preferably attached on the left and right sides of the cone portion 10*a*.

Therefore, during operation of the CRT, the inducing electrode 28 of the inducement means generates high potential from voltage Eb, and the convergence electrode 22 provides high potential from the inducing electrode 28 to the outer surface of the neck portion 8.

The potential supplied to the neck portion 8 through the convergence electrode 22 makes the potential difference between the grid electrodes and neck portion 8 decrease so that electric fields formed around the grid electrodes are effectively reduced. As a result, the compensation device can reduce convergence drift by weakening electric fields which cause electric charges to be accumulated on the neck portion 8.

Figure 6:
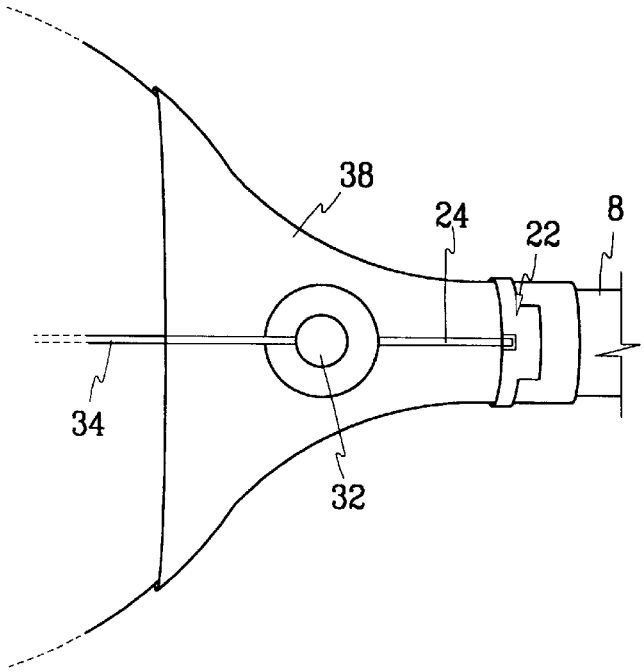
FIG. 6 is a partial lateral view of a CRT having a compensation device according to a second embodiment of the present invention.

FIG. 6 shows a second preferred embodiment of the present invention. As shown in FIG. 6, the compensation device further includes a supporting frame 38 to facilitate assemblage thereof.

The supporting frame 38 is shaped such that it corresponds with the cone portion 10*a* and neck portion 8 so as to be mounted on that position. In this structure, the supporting frame 38 fixes the convergence electrode 22 on a place that is opposite the neck portion 8, the inducement means on a place that is opposite the cone portion 10*a*, and the connecting member 24 between the convergence electrode 22 and inducement means. The supporting frame 38 may be composed of plastic materials.

Therefore, the compensation device can be assembled on the bulb by mounting the supporting frame 38 on which the compensation device is fixed on the vacuum bulb, and connecting the ground electrode 32 and the outer graphite layer 16 through another connecting member 34 to ground the ground electrode 32.

Because of the above, the present embodiment can arrange the compensation device more exactly on a preferred position and facilitate the assemblage of the compensation device.

Figure 7:
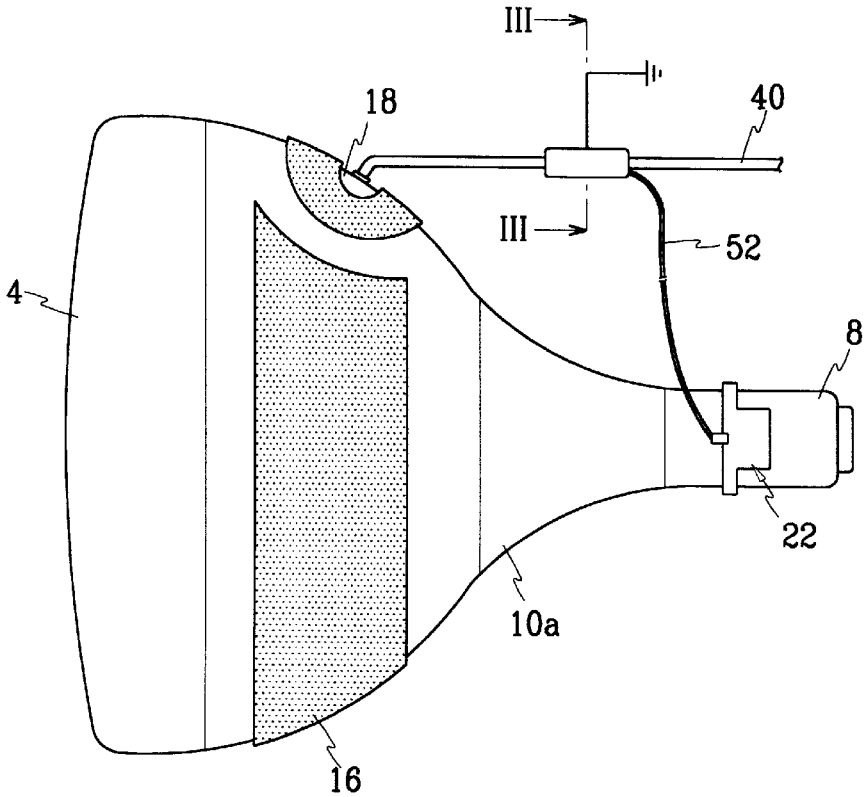
FIG. 7 is a lateral view of a CRT having a compensation device according to a third embodiment of the present invention.

FIG. 7 shows a third preferred embodiment of the present invention. As shown in FIG. 7, the inducement means is provided on an outer circumference of a voltage supply line 10 with a predetermined width. The voltage supply line 40 is connected with the anode button 18 to supply voltage Eb to the inner graphite layer 14.

Figure 8:
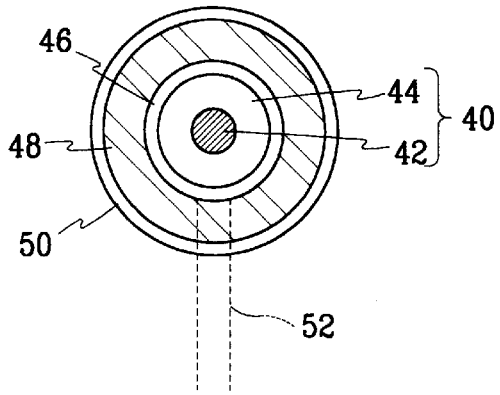
FIG. 8 is a sectional view taken along line III—III of FIG. 7.

As shown in FIG. 8, the voltage supply line 40 has a conducting wire 42 and an insulating cable 44 which surrounds the conducting wire 42. The inducement means is formed with an inducing electrode 46, dielectric layer 48, and ground electrode 50 which surround successively from an outer surface of the insulating cable 44.

The inducing electrode 46 connects with the convergence electrode 22 through a connecting cable 52, while the ground electrode 50 is grounded using another connecting cable (not shown).

In operation of the CRT, the inducing electrode 46 generates high potential from voltage Eb passing on the voltage supply line 40 according to inducement principles of static electricity. Thus, the convergence electrode 22 provides the potential from the inducing electrode 46 to the outer surface of the neck portion.

As described above, because the inducement means is formed on the cone portion 10*a* or the voltage supply line 40 and generates a high potential from the voltage Eb, the compensation device can induce the potential from the CRT itself, without having to add other electric circuits for generating the voltage.

Figure 9:
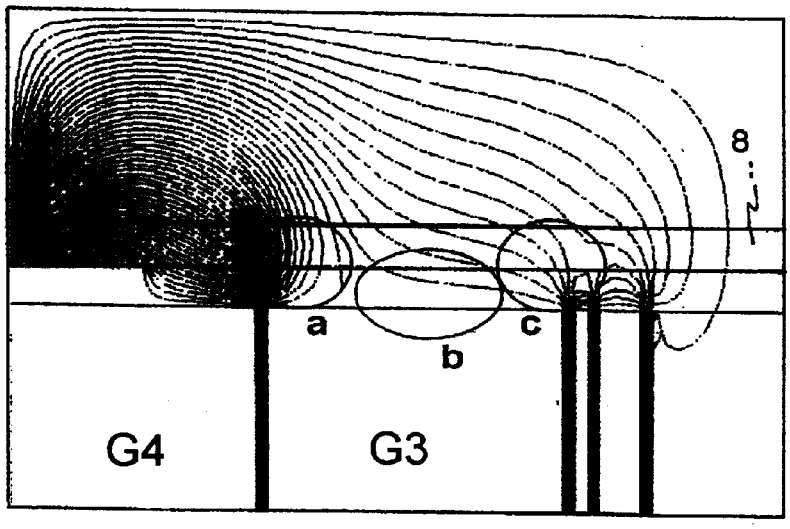
FIG. 9 (Prior Art)
FIG. 9 shows equi-potential lines formed around an electron gun assembly in a CRT according to a prior art.

FIG. 9 shows equi-potential lines formed around an electron gun assembly in a CRT according to a prior art. In the "b" area which is located in the center of the third grid electrode G3, equi-potential lines are relatively parallel to the neck portion so that electric fields are generated vertically to the neck portion. Thus, when the charges flow into the neck portion, they are easily accumulated on the "b" area due to the vertical components of the electric fields.

At the same time, equi-potential lines are formed with predetermined angles in the "a" and "c" areas which are located around each edge of the G3 electrode so that electric fields having both parallel and vertical components to the neck portion are formed. Under the electric fields, charges may be accumulated at certain areas due to the vertical components or be forced to move due to the parallel components of the electric fields.

Figure 10:
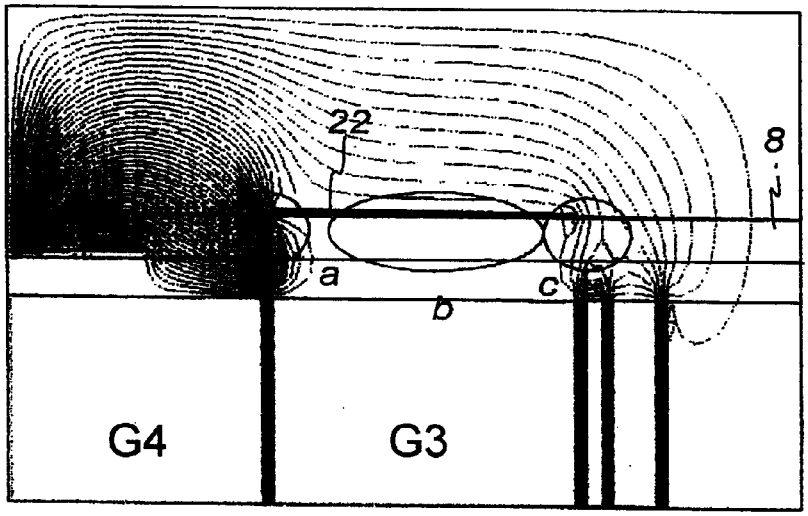
FIG. 10 shows equi-potential lines formed around an electron gun assembly in a CRT according to the present invention.

Meanwhile, FIG. 10 shows equi-potential lines formed around an electron gun assembly in a CRT according to the present invention. As shown in FIG. 10, the convergence electrode 22 is attached on the outer surface of the neck portion 8 to surround the G3 electrode, and is supplied with static 5 electricity, for example about 5 kV, from the inducement means.

Because the convergence electrode 22 provides high potential to the neck portion 8, the potential difference between the G3 electrode and the neck portion 8 is reduced so that generation of electric fields in the "b" area is effectively depressed. Also, equi-potential lines are formed substantially vertical to the neck portion 8 in the "a" and "c" areas, so that electric fields in the areas are formed parallel to the neck portion 8.

Therefore, the compensation device can prevent accumulation of charges on the "b" area due to the depressed electric fields. In addition, the compensation device can make the charges move on the "a" and "c" areas due to the parallel components of the electric fields.

Table. 1 shows voltage and width characteristics of each grid electrode of the electron gun assembly 6.

TABLE 1

| | | |
|---|---|---|
| G2 electrode | Voltage (V) | 600 |
| Dynamic focus electrode | Voltage (V) | 7,200 |
| (G3, G4, G5) | Width (mm) | 32 |
| Shield cup 20 and G6 electrode | Voltage (V) | 26,300 |
| | Width (mm) | 15 |

Figure 11:
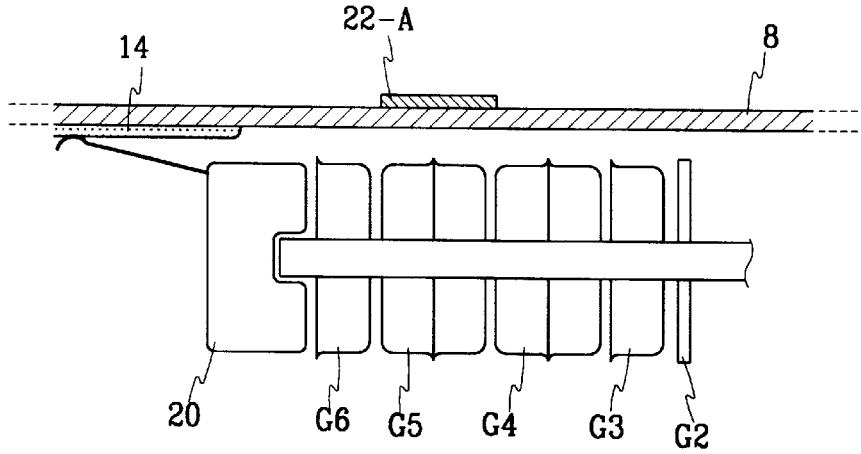
FIGS. 11 and 12 are schematic views each illustrating an attachment position of the convergence electrode.
Figure 12:
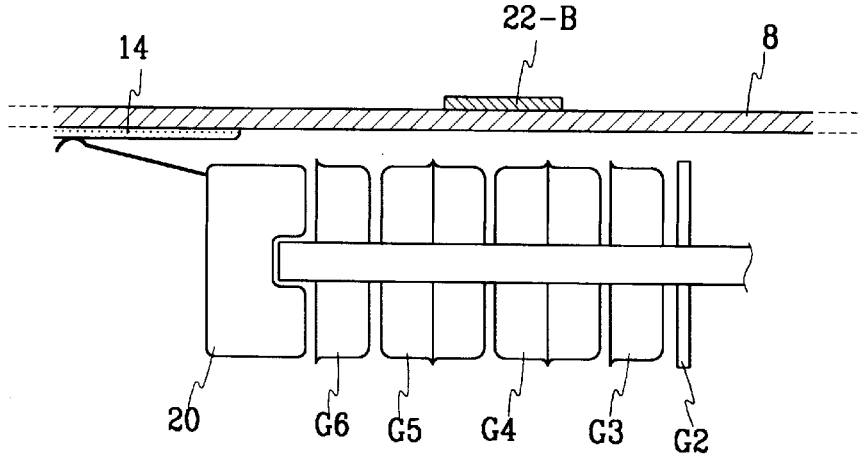

In the above electron gun assembly 6, convergence drift is tested twice according to variation of width and attachment position of convergence electrode 22 as shown in FIGS. 11 and 12. In the test, the convergence electrode positions 22-A and 22-B were opposite a dynamic focus electrode (G3, G4, G5 electrodes) and supplied with static electricity of about 5 kV from the inducement means.

Particularly, as shown in FIG. 11, the convergence electrode position 22-A used in test No. 1 has an end portion which is opposite an edge of the G5 electrode and another end portion extending in the G3 electrode direction by 14 mm. While the convergence electrode position 22-B used in test No. 2 has an end portion which is away from the edge of the G5 electrode by 8 mm and another end portion extending toward the G3 electrode and being 15 mm away. The results of convergence drift test are given in Table. 2.

TABLE 2

| | Maximum variation amount of Convergence drift (mm) |
|---|---|
| Test 1 | 0.16 |
| Test 2 | 0.13 |
| Prior art | 0.26 |

The prior art was tested in a condition that it has the same electron gun assembly with the present invention but lacks the compensation device.

As known from Table. 2, the compensation device of the present invention effectively reduces the amount of convergence drift much better than the prior art. Particularly, test No. 2 reduces 50% of the convergence drift as compared with the prior art.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A compensation device for convergence drift used in a cathode ray tube, the cathode ray tube having a face panel on which a phosphor screen is formed, a funnel including a cone portion and an inner graphite layer coated on an inner surface thereof, and a neck portion in which an electron gun assembly is arranged, comprising:

a convergence electrode provided on an outer surface of the neck portion;

an inducement means for inducing static electricity from a voltage to be supplied to the inner graphite layer; and a connecting member formed between the convergence electrode and the inducement means to supply high potential from the inducement means to the convergence electrode.

2. The compensation device of claim 1 wherein the convergence electrode comprises:

a pair of potential supply portions located to be opposite each other centering around the neck portion;

a joining portion connecting the potential supply portions in a body; and a terminal portion attached on the connecting member.

3. The compensation device of claim 1 wherein the inducement means is provided on the cone portion and induces static electricity from a voltage supplied to the inner graphite layer.

4. The compensation device of claim 3 wherein the inducement means is formed with an inducing electrode, a dielectric layer, and a ground electrode which are layered successively from the surface of the cone portion to the upper direction.

5. The compensation device of claim 4 wherein the size of the ground electrode is smaller than that of the inducing electrode.

6. The compensation device of claim 4 wherein the ground electrode connects with an outer graphite layer through another connecting member, the outer graphite layer being coated on an outer surface of the funnel.

7. The compensation device of claim 4 wherein the inducement means further includes an insulating layer formed around the ground electrode.

8. The compensation device of claim 3 which further includes another inducement means so that each of the inducement means are attached on opposite sides of the cone portion.

9. The compensation device of claim 3 which further includes a supporting frame to fix the convergence electrode, inducement means, and the connecting member thereon, the supporting frame being mounted on a circumference of the cone portion and the neck portion.

10. The compensation device of claim 9 wherein the supporting frame has a shape that corresponds with the cone portion and the neck portion.

11. The compensation device of claim 9 wherein the supporting frame is composed of plastic materials.

12. The compensation device of claim 1 wherein the inducement means is provided on a voltage supply line and induces static electricity from a voltage passing on the line, the voltage supply line being connected to an anode button to supply the voltage into the inner graphite layer.

13. The compensation device of claim 12 wherein the inducement means is formed with an inducing electrode, a dielectric layer, and a ground electrode which successively surround an outer surface of the voltage supply line.

14. A cathode ray tube, comprising:

a face panel with a phosphor screen formed on an inner surface thereof;

an electron gun assembly for emitting three electron beams into the phosphor screen;

a neck portion in which the electron gun assembly is arranged;

a funnel formed between the face panel and the neck portion, the funnel having a cone portion on which a deflection yoke is mounted;

an inner and outer graphite layer, each coated on an inner and outer surface of the funnel; and a compensation device for convergence drift, wherein the compensation device includes:

a convergence electrode provided on an outer surface of the neck portion;

an inducement means for inducing static electricity from a voltage to be supplied to the inner graphite layer; and a connecting member formed between the convergence electrode and the inducement means to supply high potential from the inducement means to the convergence electrode.

* * * * *